US005826999A

United States Patent [19]

Kageyama

[11] Patent Number: 5,826,999

[45] Date of Patent: Oct. 27, 1998

[54] MECHANICAL PENCIL

[75] Inventor: Shuhei Kageyama, Kawagoe, Japan

[73] Assignee: Kotobuki & Co., Ltd., Kyoto, Japan

[21] Appl. No.: 587,856

[22] Filed: Jan. 11, 1996

[30] Foreign Application Priority Data

Jan. 19, 1995 [JP] Japan ..... 7-006213

[51] Int. Cl.[6] ..... B43K 21/02; B43K 21/16; B43K 21/22

[52] U.S. Cl. ..... 401/54; 401/65; 401/24

[58] Field of Search ..... 401/54, 53, 52, 401/49, 55, 65, 66, 67, 74, 77, 80, 84, 92, 93, 94, 214

[56] References Cited

U.S. PATENT DOCUMENTS

| | | | |
|---|---|---|---|
| 235,122 | 12/1880 | Bowman | 401/65 |
| 1,427,999 | 9/1922 | Bell | 401/65 |
| 4,171,170 | 10/1979 | Kageyama et al. . | |
| 4,240,759 | 12/1980 | Matsumoto et al. | 401/86 X |
| 4,270,870 | 6/1981 | Hashimoto et al. | 401/94 X |
| 4,714,365 | 12/1987 | Kageyama et al. . | |
| 4,904,101 | 2/1990 | Petterson | 401/52 |
| 5,009,533 | 4/1991 | Kageyama et al. . | |
| 5,354,141 | 10/1994 | Watanabe | 401/94 X |

FOREIGN PATENT DOCUMENTS

| | | | |
|---|---|---|---|
| 0287237 | 10/1988 | European Pat. Off. | 401/53 |

OTHER PUBLICATIONS

Abstract of EP–A–0 093 815 (Kotobuki & Co., Ltd.).
Abstract of EP–A–0 168 122 (Kotobuki & Co., Ltd.).
Abstract of EP–A–0 154 073 (Kotobuki & Co., Ltd.).

*Primary Examiner*—D. Neal Muir
*Attorney, Agent, or Firm*—David O'Reilly

[57] ABSTRACT

A mechanical pencil providing a cushioning action by the action of a sleeve disposed inside of an outer barrel. The mechanical pencil comprises an outer barrel, and a lead pipe disposed inside the outer barrel. The lead pipe has a chuck mounted in the end thereof. The pencil further comprises a chuck ring mounted on the outside of the chuck, a sleeve contacting a rear end of the chuck ring slidable relative to the outer barrel, and a spring interposed between the sleeve and the lead pipe. The sleeve has a plurality of flexible pieces that spread outwardly in a radial direction. A part of each flexible piece 24*a* is inserted into a stopper hole formed on an inner wall of the outer barrel. An inclined portion contacting the rear end of the stopper hole is formed on an outer surface of each of the flexible pieces.

7 Claims, 5 Drawing Sheets

MECHANICAL PENCIL

BACKGROUND OF THE INVENTION

1. Field of the Invention

This invention relates to a mechanical pencil, particularly to a mechanical pencil having a cushioning action when excessive force is applied to the lead, by retracting the lead into outer barrel for protecting the lead from damage.

2. Background Information

This kind of a prior mechanical pencil is disclosed in Japanese Utility Model Publication No. 3-40633.

The prior mechanical pencil comprises an outer barrel, a lead pipe disposed inside the outer barrel, a chuck at the end of it, and a chuck ring disposed outside of the chuck. A sleeve contacting to the rear end of the chuck ring is slidable relative to the outer barrel, and a spring is interposed between the sleeve and the lead pipe. The sleeve is provided with a cushion portion which can extend and shrink in an axial direction. The sleeve also has a plurality of engaging projections engaging stopper holes or inner wall steps formed on the outer barrel, in a rear part behind the cushion portion. The cushion portion comprises a cylindrical member which has a plurality of holes in a side surface of the cylindrical member. The holes allow the cushion portion to extend and shrink in the axial direction.

When the engaging projection engages the outer barrel, the sleeve is biased forwardly by its own elastic force. When excessive force is applied to the lead projecting from the outer barrel when writing, the sleeve provides a cushioning action by shrinking rearward in the axial direction, retracting the lead into the outer barrel to prevent damage to the lead.

When the sleeve is assembled in the outer barrel, it is inserted into the outer barrel from the rear so that the engaging projections of the sleeve engage the stopper hole in the outer barrel. However, the engaging projections projecting outwardly in a radial direction must move in the outer barrel by being pressed inwardly until they reach the stopper hole. Therefore it is difficult to move them in the outer barrel without a jig because a large friction force is applied to the engaging projections when they move in the outer barrel. It takes a lot of time and slows productivity.

SUMMARY OF THE INVENTION

To overcome the above disadvantages, it is an object of this invention is to provide a mechanical pencil having a sleeve providing a cushioning action that can be assembled without any jigs.

The mechanical pencil according to the present invention comprises an outer barrel, a lead pipe disposed in the outer barrel, a chuck at the end of it, and a chuck ring disposed outside of the chuck. A sleeve contacting the rear end of the chuck ring, is slidable relative to the outer barrel, and a spring is interposed between the sleeve and the lead pipe. The sleeve has a plurality of flexible pieces spreading outward in a radial direction. A part of the flexible pieces is inserted into a stopper hole formed on an inner side wall of the outer barrel. An inclined portion is formed on an outer surface of each of the flexible pieces. The inclined portion contacts a rear end of the stopper hole.

The flexible pieces preferably have a step with a projecting surface adjacent to the outer end of the inclined portion. The projecting surface is parallel to a wall surface of the rear end of the stopper hole.

Preferably guide grooves are axially formed on the inner wall of the outer barrel to guide the flexible pieces of the sleeve into the stopper holes during assembly.

When excessive force is applied to the lead projecting from the outer barrel during writing, the flexible pieces that spread outwardly in a radial direction bend inwardly in a radial direction. The inclined portion provided on each of the flexible pieces displaces relative to the stopper hole so that the sleeve displaces rearwardly in an axial direction, retracting the lead into the outer barrel, as a result this cushioning action prevents damage to the lead.

When the sleeve is inserted into the outer barrel from the rear during assembly, the flexible pieces that outwardly spread in a radial direction easily bend in a radial direction so that it is possible to assemble it without any resistance force or any jigs.

In a case where the step is formed on each of the flexible pieces, the step abuts the wall surface at the rear end of the stopper hole when the sleeve is displaced rearwardly in an axial direction to a certain extent so that further displacement of the sleeve is prevented, thus the flexible pieces are protected from completely escaping from the stopper hole. The sleeve surely returns to the original position when the applied force is released.

In a case where the guide grooves are axially formed on the inner wall of the outer barrel, the guide grooves help the flexible pieces to be surely inserted into the stopper hole during assembly.

The above, and other objects, advantages and novel features of this invention will become apparent from the following detailed description and the accompanying drawings, in which like reference numbers indicate like or similar parts throughout wherein;

DETAILED DESCRIPTION OF THE INVENTION

Figure 1:
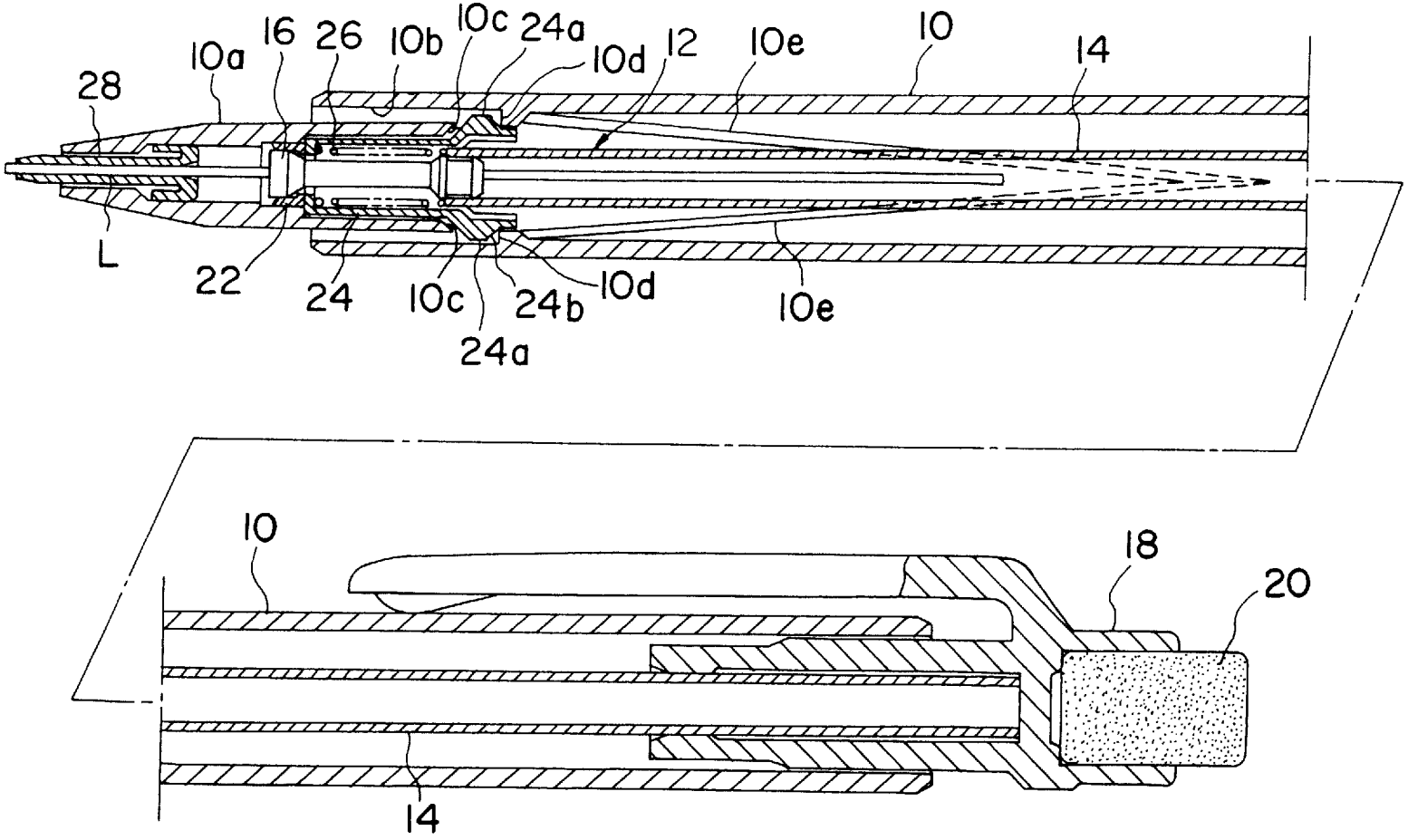
FIG. 1 is a longitudinal cross sectional view of a first embodiment according to the present invention.
Figure 2:
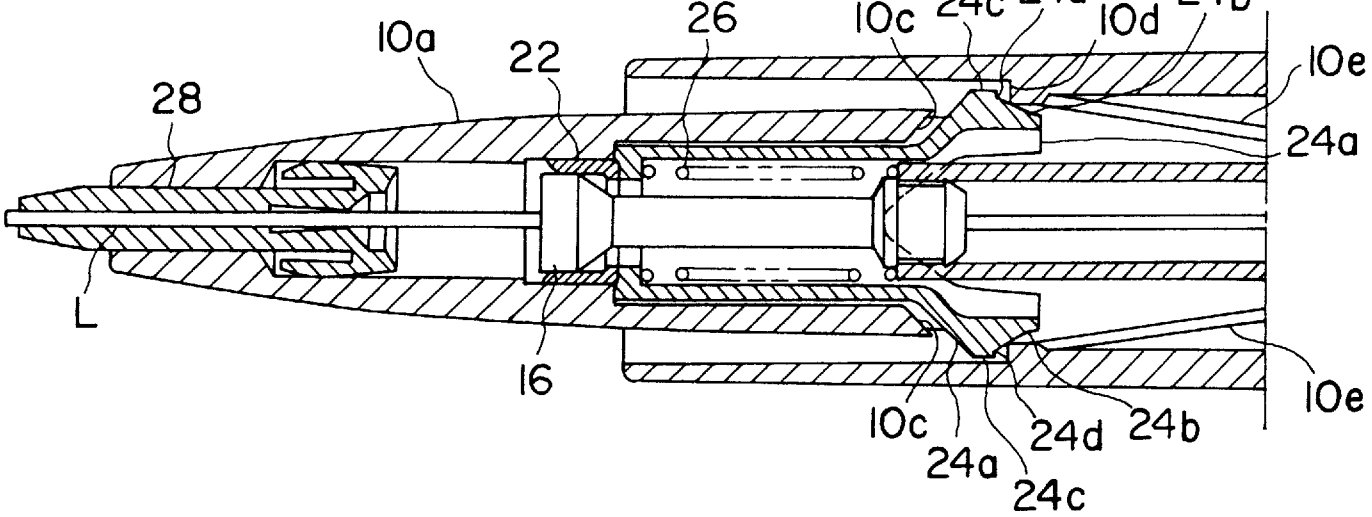
FIG. 2 is an enlarged view of a main part of the embodiment of FIG. 1.

Referring to FIGS. 1 and 2, an embodiment of the invention is described below.

Figure 4:
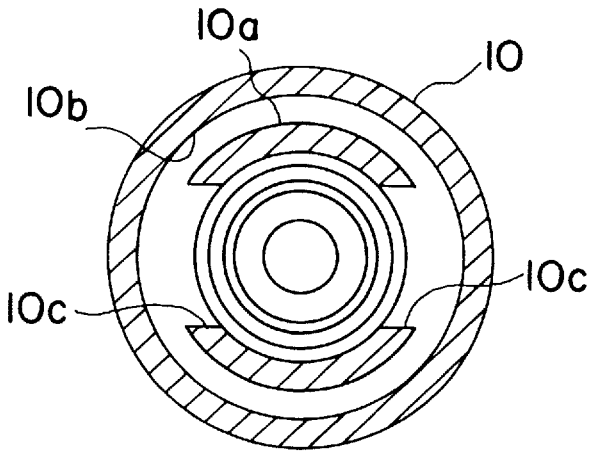
FIG. 4 is a cross sectional view taken at 4—4 line of FIG. 3.

Outer barrel 10 has an front portion having a double concentric construction comprising an outer portion and an inner portion, with the inner portion forwardly extending to form front end 10*a* of outer barrel 10. At a rear end of a space 10*b* defined between the outer portion and the inner portion of the double concentric construction, two stopper holes 10*c* communicating with a central bore of outer barrel 10 are formed at 180 degrees angular positions (see FIG. 4) to each other, in which flexible pieces 24*a* are to be inserted as described hereinafter. The aim of the double concentric construction is to form outer barrel 10 with stopper holes 10*c* by molding, but stopper holes 10*c* may also be formed on an inner wall of outer barrel 10 by boring after molding outer barrel 10.

Figure 3:
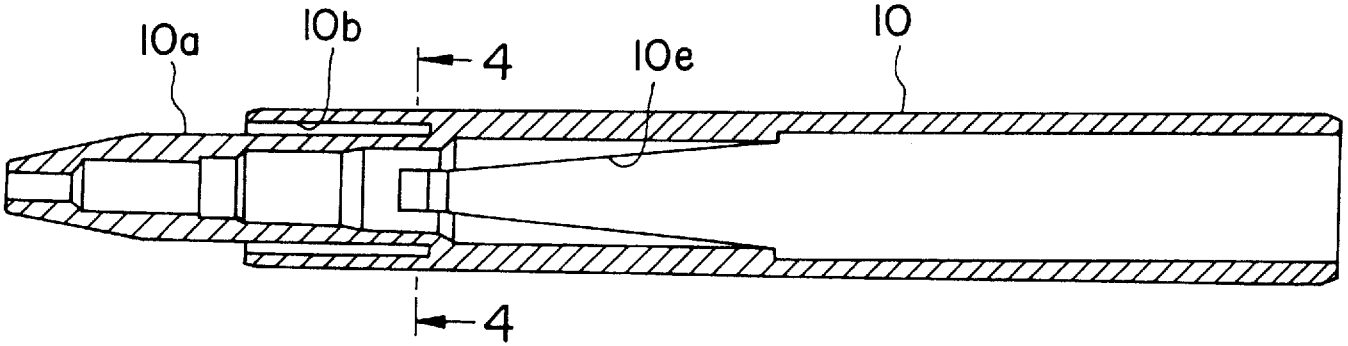
FIG. 3 is a cross sectional view of an outer barrel rotated 90 degrees about a center axis from the position shown in FIG. 1.

Guide grooves 10*e* are axially formed on the inner wall of outer barrel 10 corresponding to stopper hole 10*c* (see FIG. 3).

Lead pipe 12 is axially and movably disposed inside outer barrel 10. Lead pipe 12 has lead case 14 and chuck 16 connected to the front end of lead case 14. A knocking portion 18 is detachably mounted on a rear end of lead pipe 12 and eraser 20 is detachably mounted on a rear end of knocking portion 18.

Chuck ring 22 is mounted outside of and around chuck 16 and sleeve 24 is provided to contact the rear end of chuck ring 22. Spring 26 is interposed between sleeve 24 and lead pipe 12 so that lead pipe 12 is biased rearwardly relative to outer barrel 10. Chuck 16, chuck ring 22 and spring 26 comprise a conventional lead advancing mechanism.

Front end pipe 28 is disposed at a front end of outer barrel 10 to hold lead L protruding from the front end of outer barrel 10.

Figure 5:
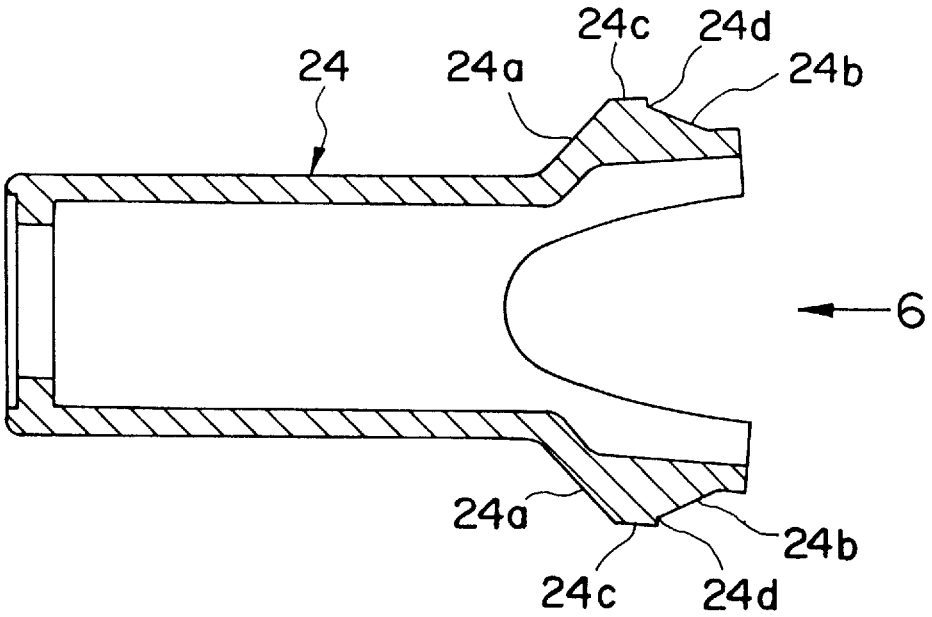
FIG. 5 is a cross sectional view of an outer barrel taken at 5—5 line of FIG. 6.
Figure 6:
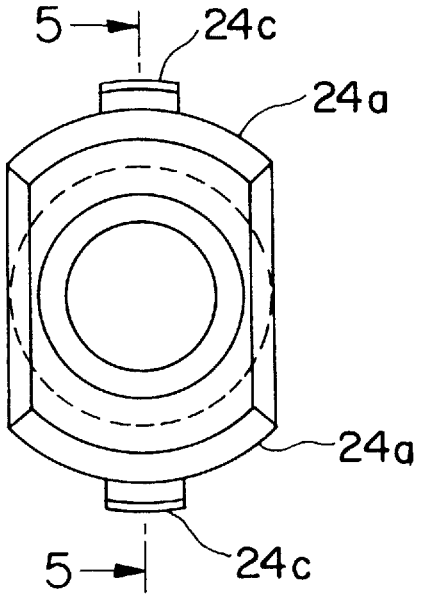
FIG. 6 is an end view seen along arrow 6 of FIG. 5.

As shown in FIGS. 5 and 6, sleeve 24 has two flexible pieces 24*a* in a rear part at 180 degrees angular positions from each other. Each flexible piece 24*a* spreads toward an outer radial direction, on the outer surface of which, are formed inclined portion 24*b* and step 24*c* adjacent to the outer top end of inclined part 24*b*. Step 24*c* has projecting surface 24*d* parallel to a wall surface of rear end 10*d* of stopper hole 10*c* after assembly.

As shown in FIG. 2, a part of each flexible piece 24*a* is inserted in stopper hole 10*c* with inclined portion 24*b* of each flexible pieces 24*a* contacting rear end 10*d* of stopper hole 10*c* so that spreading of the outer surface of each flexible piece 24*a* is restricted.

When assembling sleeve 24 into outer barrel 10, sleeve 24 is inserted into outer barrel 10 from the rear. At this time, flexible pieces 24*a* move along inner wall of outer barrel 10 and are bent inwardly in spite of the spreading force toward an outer radial direction because flexible pieces 24*a* are flexible and can be easily bent inward in a radial direction. It is thus possible to assemble sleeve 24 into outer barrel 10 without any resistance force and the need for jigs. On the other hand, in the prior mechanical pencil having engaging projections, they can not bend inwardly in a radial direction and are hard to press. Guide grooves 10*e* axially formed on the inner wall of outer barrel 10 surely guide flexible pieces 24*a* into stopper hole 10*c* during assembly.

Sleeve 24 stops when it abuts the inner surface of outer barrel 10. At this time, each flexible pieces 24*a* spread outwardly until inclined portion 24*b* of each of flexible piece 24 contacts rear end 10*d* of stopper hole 10*c* and engages rear end 10*d*. Even if there is a dimension error in either sleeve 24 or stopper hole 10*c* of outer barrel 10, the dimension error is absorbed by the adjustable spreading range of flexible pieces 24*a*.

When writing with the mechanical pencil according to this embodiment, in the case that excessive force is applied to lead L, lead pipe 12 having chuck 16 holding the lead L, chuck ring 22 and sleeve 24 are pushed rearwardly and flexible pieces 24*a* bend inwardly in a radial direction. Inclined portion 24*b* of each flexible piece 24*a* is displayed relative to rear end 10*d* of stopper hole 10*c*, as a result sleeve 24 displaces rearward in an axial direction, accompanied by lead L retracting into outer barrel 10. Such a cushioning action prevents damage to lead L.

When sleeve 24 is displaced rearward in an axial direction to a certain extent, projecting surface 24*d* of step 24*c* abuts rear end 10*d* of stopper hole 10*c* so that axial displacement of sleeve 24 stops and sleeve 24 can not move any further. Accordingly, flexible pieces 24*a* are prevented from completely escaping from stopper hole 10*c* and surely resume their original positions when the force is released.

Assuming the distance between the front end of sleeve 24 and rear end 10*d* of stopper hole 10*c* is set as "a", and the distance between the front end of sleeve 24 and projecting surface 24*d* is set as "a'", the equation a'<a must be satisfied and the difference a−a' becomes the cushioning distance.

Figure 7:
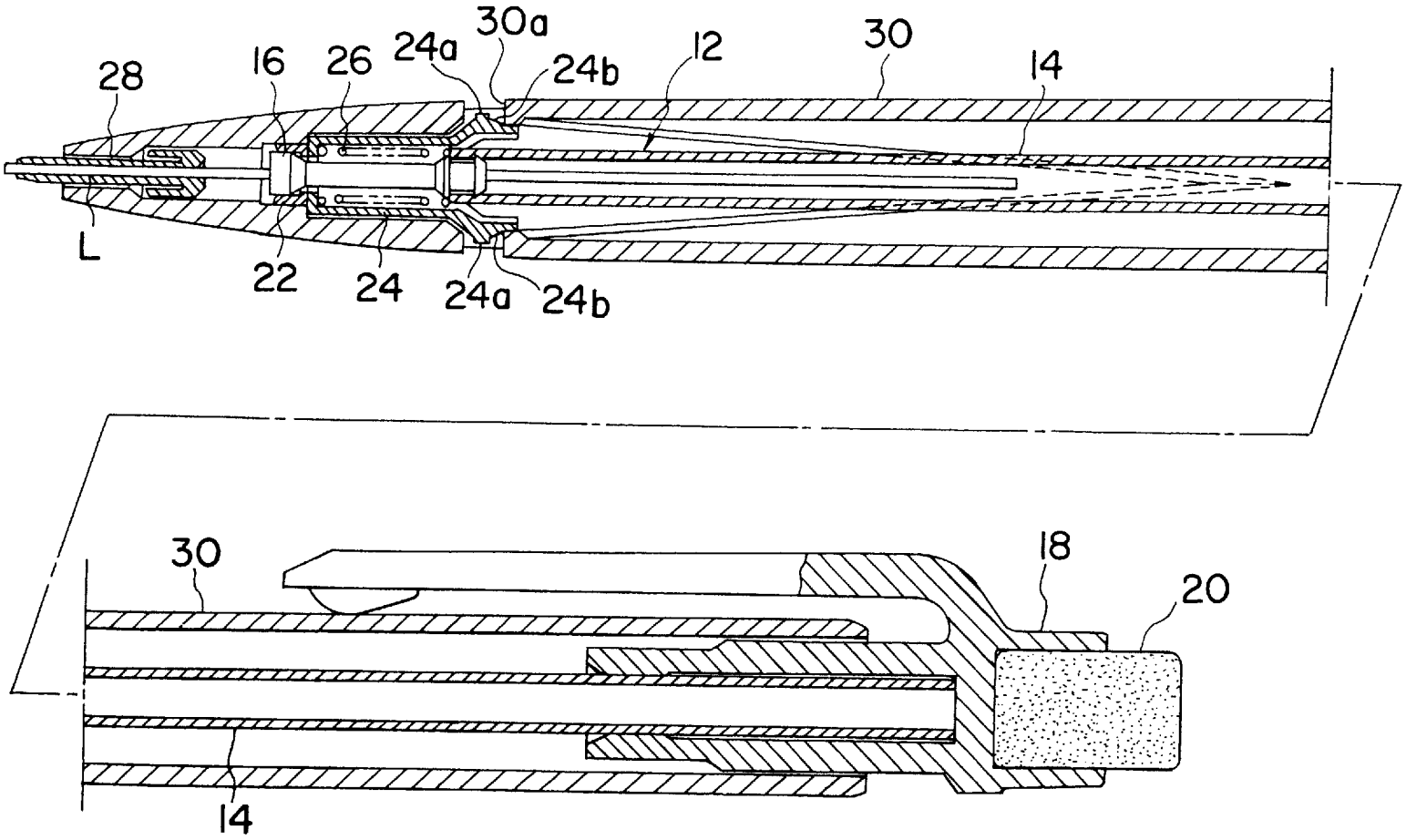
FIG. 7 is a longitudinal cross sectional view of a second embodiment according to the invention.

FIG. 7 is a longitudinal cross sectional view of an another embodiment according to this invention.

In this embodiment, outer barrel 30 has through holes 30*a* as stopper holes instead of providing the double concentric construction of the first embodiment. Otherwise the construction and operation are the same as the first embodiment.

Figure 8:
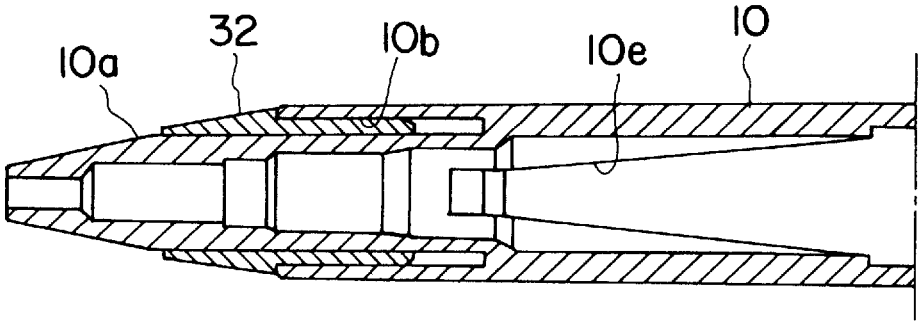
FIG. 8 is another enlarged view of a main part of the embodiment of FIG. 1.

FIG. 8 is an another enlarged view of a front portion of this invention. Packing member 32 is inserted into space 10*b* defined between the outer portion and the inner portion of the double concentric construction of outer barrel 10. This packing member 32 covers space 10*b*. When the packing member 32 is differently colored from outer barrel 10, the appearance of the mechanical pencil becomes different and value of the design can be improved.

As explained above, the radial displacement of the flexible piece of the sleeve is transduced into an axial displacement by the inclined portion for a cushioning action against excessive writing pressure. When inserting the sleeve into the outer barrel during assembly, the flexible pieces easily bend inwardly so that it is possible to insert the sleeve without any resistance force and the need for special jigs.

As explained above, in this invention, a plurality of flexible pieces that spread toward an outer radial direction are provided in the sleeve, a part of the flexible pieces are inserted into a stopper hole provided on the inner wall of the outer barrel, and an inclined portion contacts the rear end of the stopper hole formed on the outer surface of the flexible pieces. When excessive force is applied to the lead, the sleeve allows the lead to retract into outer barrel, the cushioning action preventing damage to the lead.

Having described the preferred embodiments of the invention with reference to the accompanying drawings, it is to be understood that the invention is not limited to those precise embodiments, and that various changes and modifications may be effected therein by one skilled in the art without departing from either the scope or spirit of the invention as defined in the appended claims.

What is claimed is:

1. A mechanical pencil comprising; an outer barrel; a lead pipe inserted in said outer barrel; a chuck mounted on a front end of said lead pipe; a chuck ring disposed around said chuck; an axially slidable sleeve in contact with a rear end of said chuck ring; a biasing spring interposed between said axially slidable sleeve and said lead pipe; said axially slidable sleeve having a plurality of radially extending flexible portions; a plurality of stop holes formed in said outer sleeve; projecting means on said plurality of radially extending flexible portions engaging said stop holes; said projecting means having an inclined portion abutting a rear end of said stop holes; whereby excessive force on an end of a lead projecting from said mechanical pencil causes said axially slidable sleeve to move backward cushioning the force on said lead to prevent damage.

2. The mechanical pencil according to claim 1 wherein said projecting means includes a step at an end of said inclined portion; said step constructed to have a surface parallel to an end wall at a rear end of said stop hole.

3. The mechanical pencil according to claim 2 including axial guide grooves formed on an inside surface of said outer barrel; said guide grooves constructed to guide said projecting means on said radially extending flexible portions into said stop holes.

4. The mechanical pencil according to claim 1 including axial guide grooves formed on an inside surface of said outer barrel; said guide grooves constructed to guide said projecting means on said radially extending flexible portions into said stop holes.

5. A mechanical pencil comprising an outer barrel; a lead pipe disposed inside the outer barrel; a chuck mounted on an end of said lead pipe; a chuck ring disposed around said chuck; a sleeve slidably disposed relative to said outer barrel in contact with a rear end of said chuck ring; and a spring interposed between said sleeve and said lead pipe; characterized by said sleeve having a plurality of radially flexible pieces constructed to spread outwardly in a radial direction, a part of each of said flexible pieces being inserted into a stop hole formed on an inner wall of said outer barrel, said radially flexible pieces having an inclined portion formed on the outer surface engaging a rear end wall surface of said stop hole.

6. The mechanical pencil according to claim 5, including a step formed on each of said flexible pieces adjacent to an outer end of said inclined portion, said step having a projecting surface parallel to said rear end wall surface at the rear end of said stop hole.

7. The mechanical pencil according to claim 5, including axially formed guide grooves on an inner wall of said outer barrel, said grooves constructed to guide said radially flexible pieces of said sleeve into said stop hole in said outer barrel during assembly.

* * * * *